US009512530B2

(12) United States Patent
Inazawa et al.

(10) Patent No.: US 9,512,530 B2
(45) Date of Patent: Dec. 6, 2016

(54) MOLTEN SALT BATH, DEPOSIT, AND METHOD OF PRODUCING METAL DEPOSIT

(75) Inventors: Shinji Inazawa, Osaka (JP); Koji Nitta, Osaka (JP); Kazunori Okada, Osaka (JP); Toshiyuki Nohira, Kyoto (JP)

(73) Assignees: SUMITOMO ELECTRIC INDUSTRIES, LTD., Osaka (JP); KYOTO UNIVERSITY, Kyoto (JP)

( * ) Notice: Subject to any disclaimer, the term of this patent is extended or adjusted under 35 U.S.C. 154(b) by 1756 days.

(21) Appl. No.: 11/791,518

(22) PCT Filed: Nov. 22, 2005

(86) PCT No.: PCT/JP2005/021418

§ 371 (c)(1),
(2), (4) Date: May 24, 2007

(87) PCT Pub. No.: WO2006/057231

PCT Pub. Date: Jun. 1, 2006

(65) Prior Publication Data

US 2008/0093222 A1 Apr. 24, 2008

(30) Foreign Application Priority Data

Nov. 24, 2004 (JP) ..... 2004-339416

(51) Int. Cl.
*C25D 3/66* (2006.01)

(52) U.S. Cl.
CPC ..... *C25D 3/66* (2013.01)

(58) Field of Classification Search
USPC ..... 205/230, 232
See application file for complete search history.

(56) References Cited

U.S. PATENT DOCUMENTS 3,725,220 A * 4/1973 Kessler et al. ..... 205/296
3,867,266 A * 2/1975 Miyata et al. ..... 205/232
3,954,573 A * 5/1976 Dahlgren et al. ..... 205/253
3,959,092 A * 5/1976 Komatsu et al. ..... 205/231

(Continued)

FOREIGN PATENT DOCUMENTS

JP 61-261494 11/1986
JP 02-061087 3/1990

(Continued)

OTHER PUBLICATIONS

Vossen et al, Thin Film Processes, Academic Press, New York, 1978, pp. 209, 210, 229-331.*

(Continued)

*Primary Examiner* — James Lin
(74) *Attorney, Agent, or Firm* — McDermott Will & Emery LLP

(57) ABSTRACT

A molten salt bath includes at least two types selected from the group consisting of lithium, sodium, potassium, rubidium, cesium, beryllium, magnesium, calcium, strontium, and barium; at least one type selected from the group consisting of fluorine, chlorine, bromine, and iodine; at least one element selected from the group consisting of scandium, yttrium, titanium, zirconium, hafnium, vanadium, niobium, tantalum, chromium, molybdenum, tungsten, manganese, technetium, rhenium, and lanthanoid; and an organic polymer having at least one type of a bond of carbon-oxygen-carbon and a bond of carbon-nitrogen-carbon. A deposit obtained using the molten salt bath, and a method of producing a metal deposit using the molten salt bath are provided.

7 Claims, 2 Drawing Sheets

(56) References Cited

U.S. PATENT DOCUMENTS

| | | | | |
|---|---|---|---|---|
| 4,012,293 | A * | 3/1977 | Meyerhoff | 205/51 |
| 4,036,711 | A * | 7/1977 | Kardos et al. | 205/296 |
| 4,048,024 | A * | 9/1977 | Patel et al. | 205/313 |
| 4,081,335 | A * | 3/1978 | Von Stutterheim et al. | 205/138 |
| 4,207,150 | A * | 6/1980 | Creutz et al. | 205/310 |
| 4,272,335 | A * | 6/1981 | Combs | 205/298 |
| 4,432,839 | A * | 2/1984 | Kline | 205/76 |
| 4,581,108 | A * | 4/1986 | Kapur et al. | 205/170 |
| 5,236,571 | A * | 8/1993 | Blechta et al. | 204/434 |
| 6,153,079 | A * | 11/2000 | Klam et al. | 205/141 |
| 6,203,936 | B1 * | 3/2001 | Cisar et al. | 429/518 |
| 6,677,057 | B2 * | 1/2004 | Kim | 428/659 |
| 6,936,155 | B1 * | 8/2005 | Morimitsu et al. | 205/230 |
| 7,151,049 | B2 * | 12/2006 | Beica et al. | 438/612 |
| 7,314,544 | B2 * | 1/2008 | Murphy et al. | 205/360 |
| 2003/0085133 | A1 * | 5/2003 | Totsuka et al. | 205/291 |
| 2006/0144714 | A1 * | 7/2006 | Hongo et al. | 205/296 |
| 2006/0210823 | A1 * | 9/2006 | Sano et al. | 428/606 |

FOREIGN PATENT DOCUMENTS

| | | | |
|---|---|---|---|
| JP | 04-088189 | | 3/1992 |
| JP | 5-51785 | A | 3/1993 |
| JP | 2002-295304 | A | 10/2002 |
| JP | 2003-213484 | A | 7/2003 |

OTHER PUBLICATIONS

P.M. Copham et al., "Selecting an optimum electrolyte for zinc chloride electrolysis," Journal of Applied Electrochemistry 21 (1991), p. 158-165, 1991 Chapman and Hall Ltd.

M. Masuda et al., "Electrodeposition of Tungsten and Related Voltammetric Study in a Basic $ZnCl_2$—NaCl (40-60 mol%) Melt," *Journal of the Electrochemical Society*, 148(1), 2001, p. C59-C64, The Electrochemical Society, Inc.

Katagiri, Akira, "Electrodeposition of Tungsten in $ZnCl_2$—NaCl and $ZnBr_2$—NaBr Melts," *Molten Salts and High-temperature Chemistry*, Molten Salt Committee of the Electrochemical Society of Japan, vol. 37, No. 1, 1994, p. 23-38.

I.N. Nikonowa et al., "Polytherm of the Ternary System NaCl—KCl—$ZnCl_2$," Academy of Sciences of USSR, Institute of General and Inorganic Chemistry, S. Orjonikidze Engineering-Economical Institute (1941), p. 391-400.

Hideya Takenishi et al., "Effect of Oxide Ion on the Electrodeposition of Tungsten in the $ZnCl_2$—NaCl (60-40 mol%) Melt,"Electrochemistry, 1999, vol. 67, No. 6, p. 669-676.

Japanese Office Action, with English translation, issued in Japanese Patent Application No. 2006-547777, mailed Sep. 14, 2010.

* cited by examiner

MOLTEN SALT BATH, DEPOSIT, AND METHOD OF PRODUCING METAL DEPOSIT

RELATED APPLICATIONS

This application is the U.S. National Phase under 35 U.S.C. §371 of International Application No. PCT/JP2005/021418, filed on Nov. 22, 2005, which in turn claims the benefit of Japanese Application No. 2004-339416, filed on Nov. 24, 2004, the disclosures of which Applications are incorporated by reference herein.

TECHNICAL FIELD

The present invention relates to a molten salt bath, a deposit, and a method of producing a metal deposit. Particularly, the present invention relates to a molten salt bath that can readily provide a deposit with a smooth surface, a deposit obtained using the molten salt bath, and a method of producing a metal deposit using the molten salt bath.

BACKGROUND ART

Conventionally, research efforts have been made to deposit metal from a molten salt bath by electrolysis using a molten salt bath containing metal in order to produce a metal product by electroforming or to apply a coating on a substrate. Particularly, in various fields of information communication, medical care, biotechnology, automobiles and the like these few years, attention is focused on MEMS (Micro Electro Mechanical Systems) which allow production of fine metal products that are compact in size, have high performance and energy-efficient. There is now the approach to produce fine metal products and/or to apply a coat on the surface of a fine metal product based on the application of MEMS utilizing the technique of depositing metal by electrolysis of a molten salt bath.

Non-Patent Document 1: P. M. COPHAM, D. J. FRAY, "Selecting an optimum electrolyte for zinc chloride electrolysis", JOURNAL OF APPLIED ELECTROCHEMISTRY 21 (1991), p. 158-165

Non-Patent Document 2: M. Masuda, H. Takenishi, and A. Katagiri, "Electrodeposition of Tungsten and Related Voltammetric Study in a Basic $ZnCl_2$—NaCl (40-60 mol %) Melt", Journal of the Electrochemical Society, 148(1), 2001, p. C59-C64

Non-Patent Document 3: Akira Katagiri, "Electrodeposition of Tungsten in $ZnCl_2$—NaCl and $ZnBr_2$—NaBr Melts", Molten Salts and High-temperature Chemistry, Vol. 37, No. 1, 1994, p. 23-38

Non-Patent Document 4: Nikonowa I. N., Pawlenko S. P., Bergman A. G., "Polytherm of the Ternary System NaCl—KCl—$ZnCl_2$", Bull. acad. sci. U.R.S.S., Classe sci. chim. (1941), p. 391-400

DISCLOSURE OF THE INVENTION

Problems to be Solved by the Invention

As the features of a method of depositing metal from a molten salt bath, mainly the three features (1)-(3) set forth below can be contemplated.

(1) Since a molten salt bath basically does not contain water, metal that cannot be deposited from a conventional electrolyte bath containing water principally, i.e metal more readily prone to ionization than water, can be deposited. This means that metal such as chromium and tungsten highly resistant to heat and corrosion can be deposited when a molten salt bath is used. Therefore, production of a fine metal product and coating, superior in heat resistance and durability, will be allowed.

(2) In an electrolyte bath containing water principally, the metal ions in the electrolyte bath first become a metal hydroxide. Since metal is deposited by the charge mobility of the plurality of metal hydroxide ions, the deposit will inevitably contain an oxide. Oxides in deposits will cause the problem that the unevenness of the surface of the deposit is increased and the mechanical property of the deposit is degraded (becomes brittle), or the like. On the other hand, the molten salt bath allows an oxygen-free state since a molten salt bath basically does not contain water. Therefore, inclusion of inevitable oxides in a deposit can be suppressed.

(3) In a molten salt bath, the current density for electrolysis can be made greater than an electrolyte bath containing water principally. Accordingly, metal can be deposited faster.

An example of such a molten salt bath is a LiCl (lithium chloride)-KCl (potassium chloride) eutectic molten salt bath. Specifically, a eutectic mixture having LiCl and KCl mixed at the ratio of 45 mass % and 55 mass %, respectively, can be used. In the case where tungsten, for example, is to be deposited, $WCl_4$ (tungsten tetrachloride) is added into this molten salt bath at 0.1-10 mass % (for example 1 mass %) of the mass of the molten salt bath. Then, a current of several $A/dm^2$ in current density is applied across the anode and cathode dipped in the molten salt bath for electrolysis under an Ar (argon) flow with the temperature of the molten salt bath heated to approximately 500° C. Accordingly, tungsten is deposited on the surface of the cathode.

There was a problem that the deposit such as tungsten obtained by the electrolysis of such a molten salt bath will take the form of powder having a large grain size, presenting the problem of poor surface smoothness. To overcome this problem, the grain size of the deposit had to be reduced by applying the current for energization in a pulsive manner, and/or the combination of the molten salt bath and the type of metal compound to be added into the molten salt bath had to be set appropriately. The operation thereof was extremely complicated.

In the case where an electrolyte bath containing water principally is employed, electrolysis at low temperature is allowed. Therefore, by conducting electrolysis with an electrolyte bath containing an organic type brightener and/or lubricating agent, a deposit can be obtained with a smooth surface. In the case where a molten salt bath is employed, electrolysis must be conducted with the temperature of the molten salt bath boosted higher than 400° C. Therefore, even if an organic type brightener and/or lubricating agent is added into the molten salt bath, the organic type brightener and/or lubricating agent will decompose immediately. Therefore, it was conventionally unthinkable of conducting electrolysis with an organic type brightener and/or lubricating agent included in a molten salt bath.

An object of the present invention is to provide a molten salt bath that can readily provide a deposit with a smooth surface, a deposit obtained using the molten salt bath, and a method of producing a metal deposit using the molten salt bath.

Means for Solving the Problem

The present invention is directed to a molten salt bath including at least two types selected from the group consisting of lithium, sodium, potassium, rubidium, cesium, beryllium, magnesium, calcium, strontium, and barium; at least one type selected from the group consisting of fluorine, chlorine, bromine, and iodine; at least one element selected from the group consisting of scandium, yttrium, titanium, zirconium, hafnium, vanadium, niobium, tantalum, chromium, molybdenum, tungsten, manganese, technetium, rhenium and lanthanoid; and an organic polymer including at least one type of a bond of carbon-oxygen-carbon and a bond of carbon-nitrogen-carbon. As used herein, lanthanoid refers to lanthanum, cerium, praseodymium, neodymium, promethium, samarium, europium, gadolinium, terbium, dysprosium, holmium, erbium, thulium, ytterbium, or lutetium.

In the molten salt bath of the present invention, the organic polymer may contain dipoles.

Further, the molten salt bath of the present invention preferably includes at least one element selected from the group consisting of aluminium, zinc, and tin.

Further, the molten salt bath of the present invention preferably includes at least one element selected from the group consisting of chromium, tungsten, and molybdenum.

Further, in the molten salt bath of the present invention, the organic polymer may be polyethylene glycol.

Further, in the molten salt bath of the present invention, the organic polymer may be polyethylene imine.

Further, in the molten salt bath of the present invention, the organic polymer preferably has a weight-average molecular weight of at least 3000.

Additionally, the present invention is directed to a deposit obtained using the molten salt bath set forth above.

Further, the surface of the deposit of the present invention has a ten-point average roughness Rz (JIS B0601-1994) of below 10 μm.

In addition, the present invention is directed to a method of producing a metal deposit including the step of depositing at least one type of metal selected from the group consisting of scandium, yttrium, titanium, zirconium, hafnium, vanadium, niobium, tantalum, chromium, molybdenum, tungsten, manganese, technetium, rhenium, and lanthanoid.

In the method of producing a metal deposit of the present invention, an element identical to the element of the deposited metal can be additionally supplied to the molten salt bath.

In the method of producing a metal deposit of the present invention, at least one type of metal selected from the group consisting of scandium, yttrium, titanium, zirconium, hafnium, vanadium, niobium, tantalum, chromium, molybdenum, tungsten, manganese, technetium, rhenium, and lanthanoid is deposited under the temperature of 400° C. at most for the molten salt bath.

Effect of the Invention

According to the present invention, a molten salt bath that can readily provide a deposit having a smooth surface, a deposit obtained using the molten salt bath, and a method of producing a metal deposit using the molten salt bath can be provided.

DESCRIPTION OF THE REFERENCE CHARACTERS

Figure 1:
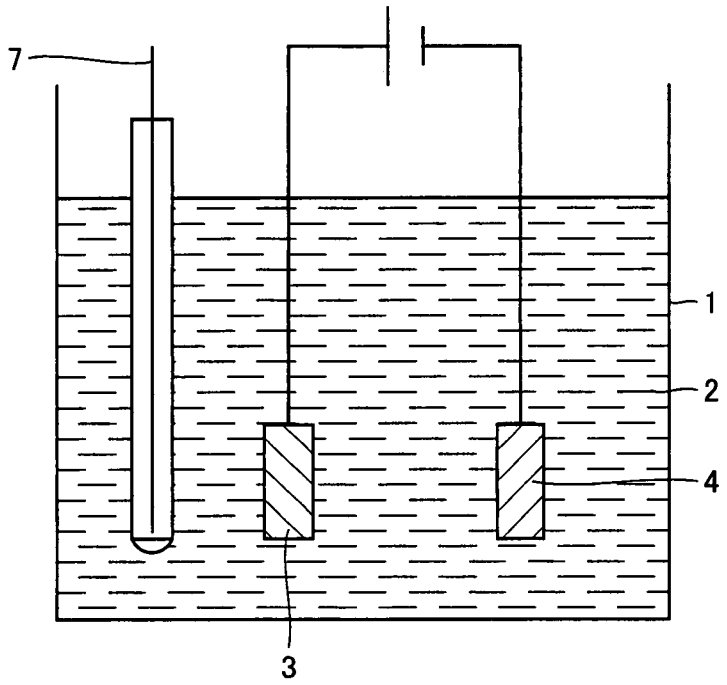
FIG. 1 represents a schematic structure of an example of an apparatus to conduct electrolysis using a molten salt bath of the present invention.

1 electrolytic tank, 2 molten salt bath, 3 anode, 4 cathode, 4*a* concave, 4*b* convex, 5 organic polymer, 6 deposit, 7 reference electrode

BEST MODE FOR CARRYING OUT THE INVENTION

An embodiment of the present invention will be described hereinafter. In the drawings of the present application, the same reference characters represent the same or corresponding elements.

The present invention is directed to a molten salt bath including at least two types selected from the group consisting of lithium, sodium, potassium, rubidium, cesium, beryllium, magnesium, calcium, strontium, and barium; at least one type selected from the group consisting of fluorine, chlorine, bromine, and iodine; at least one element selected from the group consisting of scandium, yttrium, titanium, zirconium, hafnium, vanadium, niobium, tantalum, chromium, molybdenum, tungsten, manganese, technetium, rhenium and lanthanoid (hereinafter, this element may also be referred to as "heavy metal"); and an organic polymer including at least one type of a bond of carbon-oxygen-carbon and a bond of carbon-nitrogen-carbon. The inventors of the present invention found that a deposit of heavy metal having a smooth surface can be obtained based on a molten salt bath having the composition set forth above.

The present inventors found that electrolysis of molten salt including at least two types selected from the group consisting of a halide (fluorine, chlorine, bromine, or iodine) of a predetermined alkali metal (lithium, sodium, potassium, or rubidium) and a halide of a predetermined alkaline earth metal (beryllium, magnesium, calcium, strontium or barium), and at least one of the heavy metal compound set forth above can be conducted at the low temperature of 400° C. at most for the molten salt, and that a deposit of heavy metal in the molten salt bath can be obtained by such electrolysis.

The present inventors found that the surface of the heavy metal deposit can be rendered smoother by conducting electrolysis in a molten salt bath having an organic polymer including at least one type of a bond of carbon-oxygen-carbon and a bond of carbon-nitrogen-carbon in the molten salt set forth above that allows electrolysis at the temperature of 400° C. at most.

It is considered that the surface of the heavy metal deposit is rendered smoother by the reason set forth below.

The molten salt bath of the present invention is stored in an electrolytic tank 1 shown in the schematic diagram of FIG. 1. An anode 3, a cathode 4, and a reference electrode 7 are immersed in a molten salt bath 2 kept in electrolytic tank 1. Current is conducted across anode 3 and cathode 4 for electrolysis in molten salt bath 2, whereby heavy metal in molten salt bath 2 is deposited on the surface of cathode 4.

Figure 2:
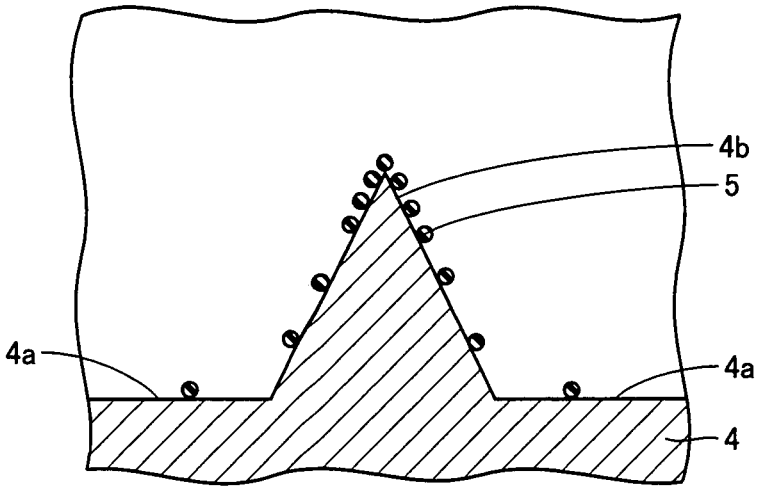
FIG. 2 is a schematic enlarged sectional view of an example of a cathode subsequent to application of voltage across an anode and cathode dipped in the molten salt bath of the present invention.

Since the surface of the cathode immersed in the molten salt bath of the present invention is slightly rough, application of voltage across the anode and cathode will cause adsorption of many organic polymers 4 containing dipoles having at least one bond of carbon-oxygen-carbon and carbon-nitrogen-carbon at a convex 4*b* of cathode 4, as shown in the schematic enlarged sectional view of FIG. 2. This is because of the fact that organic polymers 5 containing dipoles in the molten salt bath are adsorbed with priority at convex 4*b* of high current density.

Figure 3:
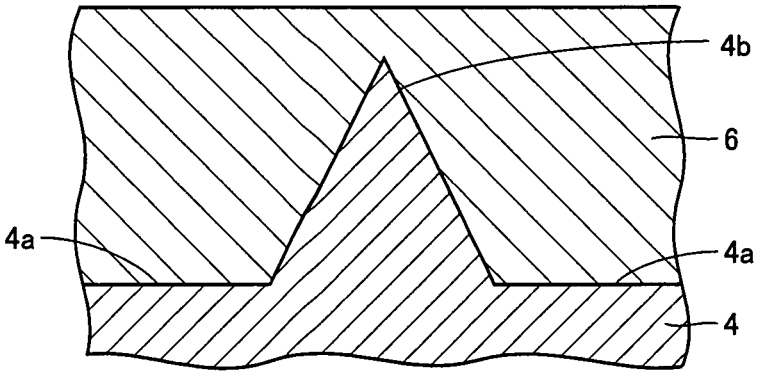
FIG. 3 is a schematic enlarged sectional view of an example subsequent to deposition of heavy metal on the surface of the cathode shown in FIG. 2.

Subsequent to adsorption of organic polymers 5, deposition of heavy metal is suppressed at convex 4*b* of cathode 4 than at concave 4*a* of cathode 4 due to the reduction reaction of heavy metal ions. This is the reason why the surface of heavy metal deposit 6 on the surface of cathode 4 is smooth, as shown by the schematic enlarged sectional view of FIG. 3.

Examples of an organic polymer employed in the present invention are polyethylene glycol, polypropylene glycol, or a copolymer of polyethylene glycol and polypropylene glycol, having the bond of carbon-oxygen-carbon, or polyamine or polyethylene imine having the bond of carbon-nitrogen-carbon.

Further, the weight-average molecular weight of the organic polymer employed in the present invention is preferably at least 3000. In this case, the decomposition temperature of the organic polymer rises such that decomposition in the molten salt bath, can be suppressed. Furthermore, there is a tendency of electrons to be localized in the organic polymer by the length of the molecule chain. Thus, there is a tendency for facilitating adsorption of organic polymers at the convex portion of the cathode.

The organic polymer is preferably mixed such that the molten salt bath of the present invention contains at least 0.0001 mass % and not more than 1 mass % of organic polymer. If the organic polymer in the molten salt bath of the present invention is mixed to correspond to less than 0.0001 mass %, there is a tendency of difficulty in obtaining the effect of a smooth surface for the deposit since the amount of organic polymers adsorbed on the convex of the deposit surface is insufficient. If the organic polymer in the molten salt bath of the present invention is mixed to correspond to more than 1 mass %, there is a tendency of adsorption at a site other than the convex of the deposit surface, inducing eutectoid, i.e. the introduction of organic polymers into the deposit, to result in the formation of many voids in the deposit. Further, in the case where the organic polymer in the molten salt bath of the present invention corresponds to more than 1 mass %, there is a tendency of the viscosity of the molten salt bath becoming higher to depress scattering of the metal ions in the molten salt bath. The deposit tends to take a dendrite form.

Further, in the case where the molten salt bath of the present invention is produced having at least one type of halide (fluorine, chlorine, bromine or iodine) selected from the group consisting of aluminium, zinc, and tin mixed, there is a tendency to lower the melting point of the molten salt bath of the present invention to allow the temperature of the molten salt bath to be further reduced at the time of electrolysis. In this case, the molten salt bath of the present invention contains aluminium, zinc, or tin. At least one type of halide selected from the group consisting of aluminium, zinc, and tin is preferably mixed such that the total content of aluminium, zinc and tin in the molten salt bath of the present invention is at least 0.01 mol % and not more than the saturating amount. In the case where at least one type of halide selected from the group consisting of aluminum, zinc and tin is mixed such that the total content of aluminium, zinc and tin in the molten salt bath of the present invention is less than 0.01 mol %, the total amount of aluminium, zinc and tin will be so low with respect to the current for electrolysis of the molten salt bath that most of the current will be used in the decomposition of moisture in the molten salt bath. There is a tendency of significant degradation in the efficiency of current used for forming a deposit.

Further, in the case where at least one element selected from the group consisting of chromium, tungsten and molybdenum is included in the molten salt bath of the present invention, at least one element selected from the group consisting of chromium, tungsten and molybdenum can be deposited. Therefore, a deposit highly resistant in heat and durability can be obtained. At least one element selected from the group consisting of chromium, tungsten and molybdenum is preferably mixed such that the total content of chromium, tungsten and molybdenum in the molten salt bath of the present invention is at least 0.01 mol % and not more than the saturating amount. If at least one type of element selected from the group consisting of chromium, tungsten and molybdenum is mixed such that the total content of chromium, tungsten and molybdenum in the molten salt bath of the present invention is less than 0.01 mol %, the total amount of chromium, tungsten and molybdenum with respect to the current for electrolysis of the molten salt bath will become so low that most of the current will be used for decomposition of moisture in the molten salt bath. Therefore, there is a tendency of significant reduction in the efficiency of current used for forming a deposit.

The form of lithium, sodium, potassium, rubidium, cesium, beryllium, magnesium, calcium, strontium, barium, fluorine, chlorine, bromine, iodine, scandium, yttrium, titanium, zirconium, hafnium, vanadium, niobium, tantalum, chromium, molybdenum, tungsten, manganese, technetium, rhenium, lanthanoid, aluminium, zinc or tin that may be contained in the molten salt bath of the present invention is not particularly limited. These elements may be present as ions, for example, or in a form constituting a complex in the molten salt bath. The presence of these elements can be detected by conducting ICP (inductively coupled plasma spectrometry) analysis on a sample prepared by dissolving the molten salt bath of the present invention in water.

Further, the presence of an organic polymer having at least one type of a bond of carbon-oxygen-carbon and a bond of carbon-nitrogen-carbon in the molten salt bath of the present invention can be detected by conducting FT-IR (Fourier transform infrared spectroscopy) on a sample prepared by dissolving the molten salt bath of the present invention in water.

By employing the molten salt bath of the present invention set forth above, electrolysis of molten salt bath is allowed at the low temperature of below 400° C. for the molten salt bath. Therefore, even in the case where an electroforming mold having a resist pattern formed by directing an X-ray to resin such as polymethyl methacrylate (PMMA) on a conductive substrate is immersed as the cathode in the molten salt bath, deformation of the resist pattern caused by the temperature of the molten salt bath can be suppressed.

Examples of a conductive substrate are a substrate formed of metal alone or alloy, a substrate having a coat of conductive metal or the like applied on a non-conductive substrate such as glass, and the like. On the exposed portion of the surface of the conductive substrate where no resist pattern is formed, the heavy metal in the molten salt bath is deposited by the electrolysis of the molten salt bath. The deposit thus obtained is employed in, for example, a contact probe, micro-connector, micro-relay, or various sensor components. The deposit is also employed for RFMEMS (Radio Frequency Micro Electro Mechanical System) such as a variable capacitor, inductor, array, or antenna, optical MEMS members, ink jet heads, electrodes in biosensors, power MEMS members (such as an electrode), or the like.

In view of the application to a relatively thick coat film or electroforming for the deposit of the present invention, the possibility of the deposit containing a void in the formation process thereof is high if the surface roughness of the deposit is significant. Therefore, the surface of the deposit of the present invention preferably has a ten-point average roughness Rz (JIS B0601-1994) of less than 10 μm. More preferably, the ten-point average roughness Rz of the surface of the deposit of the present invention is less than 1 μm. The surface smoothness of the deposit may be critical in the case where the deposit of the present invention is used as the plating film for surface coating. This is because, when the deposit is used as a plating film for surface coating of a microscopic component, it will be difficult to polish the deposit after formation thereof.

EXAMPLE

Example 1

The powder of LiBr (lithium bromide), KBr (potassium bromide) and CsBr (cesium bromide) were each weighed in a glove box under Ar (argon) atmosphere to attain a eutectic composition having the mol ratio of 56.1:18.9:25.0. Then, the powder was placed in an alumina crucible in the same glove box.

Further, the powder of $CrCl_2$ (chromium dichloride) was weighed in the same glove box such that $CrCl_2$ was 2.78 mol with respect to the 100 mol mixture of LiBr and KBr and CsBr stored in the aforementioned alumina crucible. The $CrCl_2$ powder was placed in the aforementioned alumina crucible.

Then, the alumina crucible with LiBr, KBr, CsBr and $CrCl_2$ was heated in the glove box set forth above such that the powder in the alumina crucible melted. Thus, 150 g of molten salt was prepared. 0.0195 g of polyethylene glycol (PEG) having a weight-average molecular weight of 20000 was added to the molten salt to complete the molten salt bath of Example 1.

In this molten salt bath of Example 1, a nickel plate having the oxide at the surface removed by a solution containing $NaHF_2$ was immersed as the cathode and a chromium rod was immersed as the anode in the glove box set forth above. In addition, an Ag+/Ag electrode was immersed as a reference electrode.

Constant-current electrolysis was conducted for 2 hours at the potential of 50 mV lower than the threshold potential of the reduction current caused by deposition of Cr (chromium) under the state where the temperature of the molten salt bath was maintained at 250° C., whereby Cr was deposited on the surface of the nickel plate qualified as the cathode. The aforementioned constant-current electrolysis was conducted while additionally supplying $CrCl_2$ powder appropriately into the molten salt bath. Therefore, an element identical to that deposited has been additionally added into the molten salt bath of Example 1.

Then, the nickel plate subjected to Cr deposition was taken out from the glove box into the atmosphere. The surface roughness of the Cr deposit was evaluated. The result is shown in Table 1. Evaluation of the surface roughness of the Cr deposit was conducted using a laser microscope (Type "VK-8500" of Keyence Co.). A lower value for the surface roughness shown in FIG. 1 represents a deposit of a smoother surface. The surface roughness shown in Table 1 corresponds to ten-point average roughness Rz (JIS B0601-1994).

The ten-point average roughness (Rz) at the surface of the Cr deposit obtained using the molten salt bath of Example 1 was 1 μm, as shown in Table 1.

Example 2

A molten salt bath of Example 2 was produced in a manner similar to that of Example 1 with the exception that 0.0705 g of polyethylene glycol (PEG) having a weight-average molecular weight of 20000 was added. Cr was deposited on the surface of the nickel plate qualified as the cathode, and evaluation similar to that of Example 1 was conducted for the surface roughness of the deposit. The result is shown in Table 1.

The ten-point average roughness (Rz) was 0.5 μm at the surface of the Cr deposit obtained using the molten salt bath of Example 2, as shown in Table 1.

Example 3

A molten salt bath of Example 3 was produced in a manner similar to that of Example 1 with the exception that 0.0225 g of polyethylene glycol (PEG) having a weight-average molecular weight of 100000 was added. Cr was deposited on the surface of the nickel plate qualified as the cathode, and evaluation similar to that of Example 1 was conducted for the surface roughness of the deposit. The result is shown in Table 1.

The ten-point average roughness (Rz) was 0.91 μm at the surface of the Cr deposit obtained using the molten salt bath of Example 3, as shown in Table 1.

Example 4

A molten salt bath of Example 4 was produced in a manner similar to that of Example 1 with the exception that 0.048 g of polyethylene glycol (PEG) having a weight-average molecular weight of 100000 was added. Cr was deposited on the surface of the nickel plate qualified as the cathode, and evaluation similar to that of Example 1 was conducted for the surface roughness of the deposit. The result is shown in Table 1.

The ten-point average roughness (Rz) was 0.82 μm at the surface of the Cr deposit obtained using the molten salt bath of Example 4, as shown in Table 1.

Example 5

A molten salt bath of Example 5 was produced in a manner similar to that of Example 1 with the exception that 0.0855 g of polyethylene glycol (PEG) having a weight-average molecular weight of 100000 was added. Cr was deposited on the surface of the nickel plate qualified as the cathode, and evaluation similar to that of Example 1 was conducted for the surface roughness of the deposit. The result is shown in Table 1.

The ten-point average roughness (Rz) was 0.75 μm at the surface of the Cr deposit obtained using the molten salt bath of Example 5, as shown in Table 1.

Example 6

A molten salt bath of Example 6 was produced in a manner similar to that of Example 1 with the exception that 0.0405 g of polyethylene imine (PEI) having a weight-average molecular weight of 750000 was added instead of polyethylene glycol. Cr was deposited on the surface of the nickel plate qualified as the cathode, and evaluation similar to that of Example 1 was conducted for the surface roughness of the deposit. The result is shown in Table 1.

The ten-point average roughness (Rz) was 0.46 μm at the surface of the Cr deposit obtained using the molten salt bath of Example 6, as shown in Table 1.

Comparative Example 1

A molten salt bath of Comparative Example 1 was produced in a manner similar to that of Example 1 with the exception that an organic polymer such as polyethylene glycol (PEG) was not added. Cr was deposited on the surface of the nickel plate qualified as the cathode immersed in the molten salt bath of Comparative Example 1, and evaluation similar to that of Example 1 was conducted for the surface roughness of the deposit. The result is shown in Table 1.

The ten-point average roughness (Rz) was 10 μm at the surface of the Cr deposit obtained using the molten salt bath of Comparative Example 1, as shown in Table 1.

TABLE 1

| | Composition of Molten Salt Bath | | | | | | | |
|---|---|---|---|---|---|---|---|---|
| | Composition of Molten Salt (mol ratio) | | | | PEG (weight-average molecular weight: 20000) added | PEG (weight-average molecular weight: 100000) added | PEI (weight-average molecular weight: 750000) added | Evaluation Result Surface roughness Rz |
| | LiBr | KBr | CsBr | $CrCl_2$ | (g) | (g) | (g) | (μm) |
| Example 1 | 56.1 | 18.9 | 25.0 | 2.78 | 0.0195 | 0 | 0 | 1 |
| Example 2 | 56.1 | 18.9 | 25.0 | 2.78 | 0.0705 | 0 | 0 | 0.5 |
| Example 3 | 56.1 | 18.9 | 25.0 | 2.78 | 0 | 0.0225 | 0 | 0.91 |
| Example 4 | 56.1 | 18.9 | 25.0 | 2.78 | 0 | 0.048 | 0 | 0.82 |
| Example 5 | 56.1 | 18.9 | 25.0 | 2.78 | 0 | 0.0855 | 0 | 0.75 |
| Example 6 | 56.1 | 18.9 | 25.0 | 2.78 | 0 | 0 | 0.0405 | 0.46 |
| Comparative Example 1 | 56.1 | 18.9 | 25.0 | 2.78 | 0 | 0 | 0 | 10 |

As shown in Table 1, the Cr deposits obtained using the molten salt baths of Examples 1-6 containing polyethylene glycol (PEG) or polyethylene imine (PEI) all had a ten-point average roughness Rz that is below 1 μm. It was confirmed that the surface was smoother than the surface of the Cr deposit obtained using the molten salt bath of Comparative Example 1 that is completely absent of an organic polymer such as polyethylene glycol (PEG).

It should be understood that the embodiments and examples disclosed herein are illustrative and non-restrictive in every respect. The scope of the present invention is defined by the terms of the claims, rather than the description above, and is intended to include any modification within the scope and meaning equivalent to the terms of the claim.

INDUSTRIAL APPLICABILITY

By the molten salt bath of the present invention, a deposit having a smooth surface can be obtained.

The invention claimed is:

1. A molten salt bath for depositing at least one element selected from the group consisting of scandium, yttrium, titanium, zirconium, hafnium, vanadium, niobium, chromium, molybdenum, tungsten, manganese, technetium, rhenium, and lanthanoid including:

at least two elements selected from the group consisting of lithium, sodium, potassium, rubidium, cesium, beryllium, magnesium, calcium, strontium, and barium;

at least one element selected from the group consisting of chlorine, bromine, and iodine;

at least one element selected from the group consisting of scandium, yttrium, titanium, zirconium, hafnium, vanadium, niobium, chromium, molybdenum, tungsten, manganese, technetium, rhenium, and lanthanoid; and polyethylene imine, wherein said polyethylene imine has a weight-average molecular weight of at least 3000.

2. The molten salt bath according to claim 1, including at least one element selected from the group consisting of aluminium, zinc, and tin.

3. The molten salt bath according to claim 1, including at least one element selected from the group consisting of chromium, tungsten, and molybdenum.

4. A method of producing a metal deposit including the step of depositing at least one metal selected from the group consisting of scandium, yttrium, titanium, zirconium, hafnium, vanadium, niobium, tantalum, chromium, molybdenum, tungsten, manganese, technetium, rhenium, and lanthanoid from the molten salt bath according to claim 1.

5. The method of producing a metal deposit according to claim 4, wherein an element identical to said deposited metal is additionally supplied to said molten salt bath.

6. The method of producing a metal deposit according to claim 4, wherein at least one metal selected from the group consisting of scandium, yttrium, titanium, zirconium, hafnium, vanadium, niobium, tantalum, chromium, molybdenum, tungsten, manganese, technetium, rhenium, and lanthanoid is deposited under a temperature of 400° C. at most for said molten salt bath.

7. A molten salt bath for depositing chromium, including:

lithium bromide;

potassium bromide;

cesium bromide;

chromium dichloride; and polyethylene imine, wherein said polyethylene imine has a weight-average molecular weight of at least 3000.

* * * * *